United States Patent [19]

Fischer

[11] Patent Number: 4,700,107

[45] Date of Patent: Oct. 13, 1987

[54] HIGH-PRESSURE DISCHARGE LAMP HAVING A TUNGSTEN SHEET ELECTRODE

[75] Inventor: Hanns E. Fischer, Stolberg, Fed. Rep. of Germany

[73] Assignee: U.S. Philips Corporation, New York, N.Y.

[21] Appl. No.: 799,524

[22] Filed: Nov. 19, 1985

[30] Foreign Application Priority Data

Dec. 8, 1984 [DE] Fed. Rep. of Germany ..... 3444922

[51] Int. Cl.[4] ..... H01J 61/06

[52] U.S. Cl. ..... 313/631; 313/333

[58] Field of Search ..... 313/631, 632, 623, 331, 313/333

[56] References Cited

U.S. PATENT DOCUMENTS 1,723,929 8/1929 Francotte ..... 313/631 X 2,876,377 3/1959 Retzer et al. ..... 313/623

3,080,497 3/1963 Noel et al. ..... 313/331 X 4,101,799 7/1978 Wiedijk et al. ..... 313/331

FOREIGN PATENT DOCUMENTS 530405 12/1940 United Kingdom .

*Primary Examiner*—Palmer C. DeMeo

*Assistant Examiner*—Sandra L. O'Shea

*Attorney, Agent, or Firm*—David R. Treacy

[57] ABSTRACT

An electrode head for a high-pressure discharge lamp consists of tungsten sheet material formed as a flat or curved plate having an elongated end face having a transverse dimension at least three or five times the plate thickness. As a result the discharge arc terminates practically in pointed form on the electrode end face, and the electrode is heated relatively slightly but has a large surface for thermal emission.

4 Claims, 4 Drawing Figures

HIGH-PRESSURE DISCHARGE LAMP HAVING A TUNGSTEN SHEET ELECTRODE

BACKGROUND OF THE INVENTION

The invention relates to a high-pressure gas discharge lamp having electrodes, at least one of which has an electrode head consisting of tungsten sheet material, on which the discharge arc terminates during operation of the lamp. The term "sheet material" is to be understood herein to mean a plate-shaped material, whose thickness is smaller than a third of its largest transverse dimension, and is preferably smaller than a fifth thereof.

Electrodes for high-pressure gas discharge lamps are frequently in the form of helices of tungsten wire, which are wound onto a tungsten pin, the central pin projecting from the helix or only extending into the lower part of the helix depending upon the use. For specific lamp types, for example ultra-high-pressure xenon lamps, use is also made of specifically formed rotational bodies of tungsten or spheres of tungsten fused to current supply wires. However, helix electrodes of tungsten wire are generally preferred to solid bodies because the discharge arc terminates only on a small piece of the wire. The length of this piece substantially corresponds to the wire diameter. Thus, the thermal load of the electrode remains lower than in the case of solid bodies, but on the other hand a large surface area is available for the emission of the heat supplied. Therefore, with such electrodes, the removal of tungsten and hence the blackening of the lamp bulb can be kept low, as a result of which the life of the lamp is considerably lengthened.

In small discharge lamps having a bulb diameter of the order of 1 cm, however, the reproducible manufacture of helix electrodes involves great difficulty. For example, the overall dimensions of an electrode for a lamp power of 30 W are only 0.8 mm in all. The heat balance of the electrode can be changed considerably by small errors; for example, hiatuses between two turns of only a few microns can, lead to deviations of the electrical or color properties of the lamp.

British Patent Specification No. 530 405 discloses electrodes for 100 to 300 W high-pressure gas discharge lamps, whose electrode head consists of tungsten sheet material. The tungsten sheet material of the electrode is either bent into the form of a U or constructed as a cylinder closed on the front side or as a spherical bowl (FIGS. 2 to 4), the discharge terminating on a comparatively large end face of the electrodes in order to obtain a largest possible emitting zone. Due to the large termination surface for the discharge arc, the thermal load of the electrodes is very high. This load leads to a short life of the corresponding lamps.

Another electrode known from GB PS No. 530 405 (FIG. 15) consists of a straight piece of wire which extends in the axial direction of the lamp, and to which a helically bent metal foil is secured. This foil slightly recedes with respect to the free wire end. Solely at the instant of ignition, a glow discharge terminates on the foil; the actual discharge arc always terminates on the wire end, however. However, there is a risk that the electrode head may melt away when it takes the form of a thin wire tip. Moreover, the thin piece of wire is not practically able to dissipate the heat produced by the discharge in the wire tip or in the metal foil. Such electrodes therefore have only a short life.

SUMMARY OF THE INVENTION

Therefore, the invention has for its object to provide a high-pressure gas discharge lamp having electrodes which can be manufactured in a simple and very reproducible manner, but on the other hand have the favorable properties of helix electrodes, that is a low thermal load and favourable emission properties.

According to the invention, this object is achieved in a high-pressure gas discharge lamp of the kind mentioned in the opening paragraph in that the electrode head is constructed as a flat or curved plate, whose elongate front end face facing the discharge serves as the only termination surface for the discharge arc.

The electrode head of such an electrode has at its end face a cross-section whose one side is considerably smaller than the other side, because the plate width is at least three or five times its thickness. Since the discharge arc terminates practically in pointed form on this electrode end face the electrode is heated only comparatively slightly. On the other hand, the electrode has a large surface for thermal emission. Thus, an overheating of the electrode is avoided and a correspondingly long life is attained.

A current supply strip can be welded to the electrode head which is constructed as a flat or curved plate. However, it is more advantageous if, according to a further embodiment of the invention, the electrode head and the current supply strip connected thereto consist of one piece of tungsten sheet material. In this case, the electrode head and the current supply strip can be stamped in one piece out of tungsten sheet material. Thus, a uniform heat transition is obtained between the electrode head and the current supply strip. Moreover, the flat current supply strips thus obtained can be sealed more readily into the quartz glass of the lamp bulb and distribute the heat to be transported over a larger surface. Thus, a higher thermal load is possible at the point of entrance into the quartz bulb. This arrangement favorably in turn influences the temperature profile of the bulb wall.

In a usual manner, the current supply strips are welded to a molybdenum foil, which is etched into the shape of a lens and which is then sealed as a sealing portion into the quartz glass bulb so as to be resistant to pressure. According to a further embodiment of the invention, the sealing portion embedded in the lamp bulb is also made in one piece with the electrode.

Efficaciously, the whole electrode, inclusive of the sealing portion, is stamped as an integral part out of tungsten sheet material, while the sealing portion can then take a lens-shaped cross-section, for example by etching.

In order that the invention may be readily carried out, it will now be described more fully with reference to the accompanying drawing.

DESCRIPTION OF THE PREFERRED EMBODIMENTS

Figure 1:
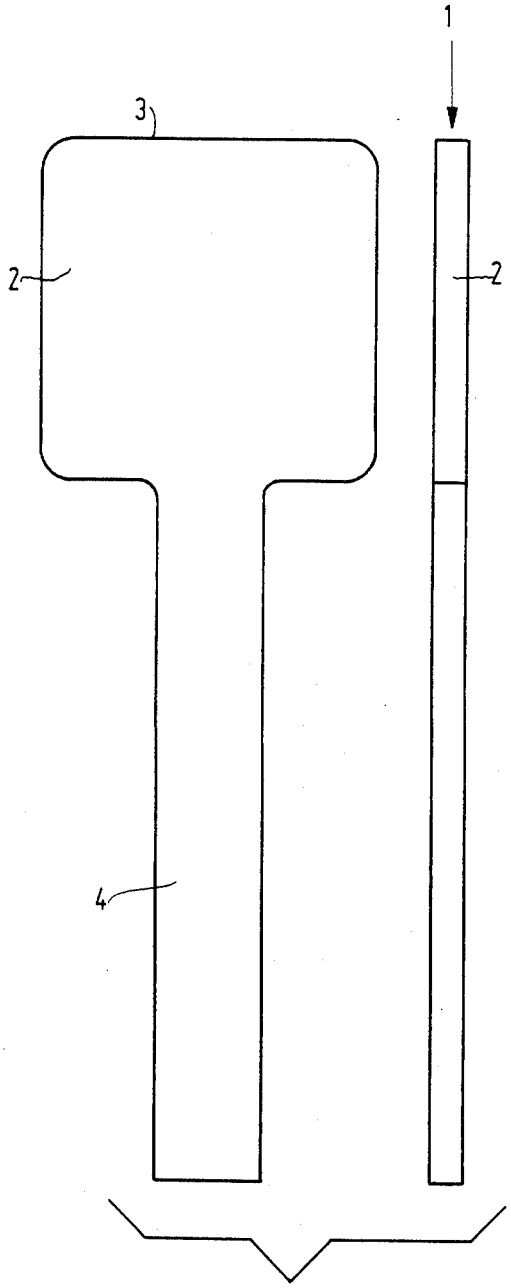
FIG. 1 is a plan view and a side elevation of an electrode head which is made of tungsten sheet material and is manufactured in one piece with a current supply strip.

The electrode for a high-pressure gas discharge lamp shown in FIG. 1 consists of a piece of tungsten sheet material 1. The actual electrode head 2 on which the discharge arc terminates during operation of the lamp, is constructed as a flat piece having a substantially square surface. The rectangular front end face 3 of the electrode head 2 faces the discharge and serves as the only termination surface for the discharge arc. The electrode head 2 is adjoined by a current supply strip 4, which is made in one piece with the electrode head 2. The electrode head 2 can be stamped together with the current supply strip 4 out of tungsten sheet material.

Figure 2:
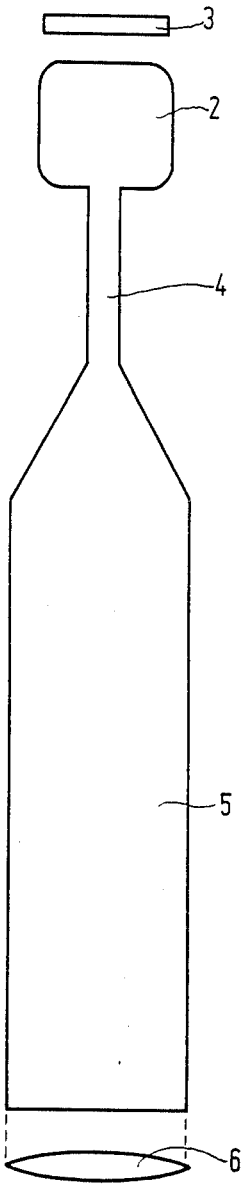
FIG. 2 is a plan view and a front elevation and rear elevation of a lamp electrode, whose electrode head, current supply strip and sealing portion are made in one piece of tungsten sheet material.

The upper section of the electrode arrangement shown in FIG. 2 corresponds to the electrode shown in FIG. 1. Corresponding parts are therefore designated by the same reference symbols. In this case, the current supply strip 4 is adjoined by a sealing portion 5 which also consists of tungsten sheet material and which is made in one piece with the current supply strip 4 and the electrode head 2. The whole electrode arrangement consisting of the electrode head 2, the current supply strip 4 and the sealing portion 5 can be stamped as an integral part out of thin tungsten sheet material. In order to facilitate and to improve the process of sealing the sealing portion 5 into the quartz glass of a lamp bulb, the sealing portion 5 is given a lens-shaped cross-section 6, for example by etching.

Figure 3:
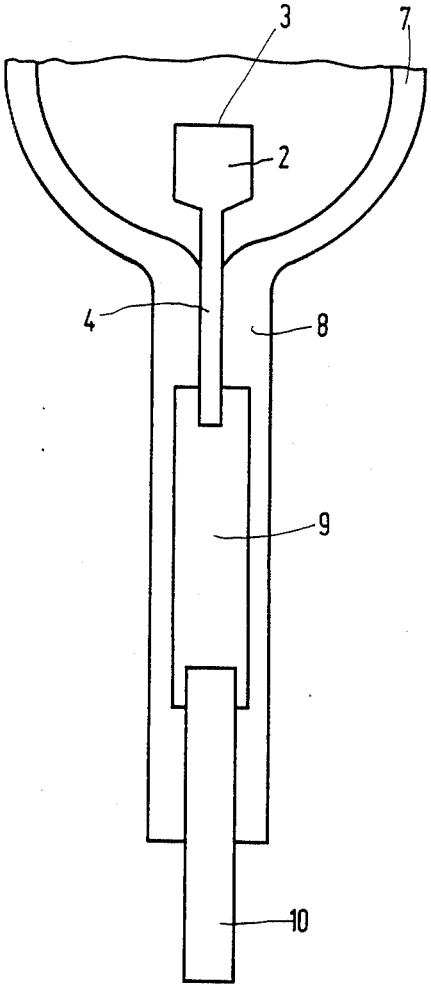
FIG. 3 is a sectional view of an end of a high-pressure gas discharge lamp having an electrode as shown in FIG. 1.
Figure 4:
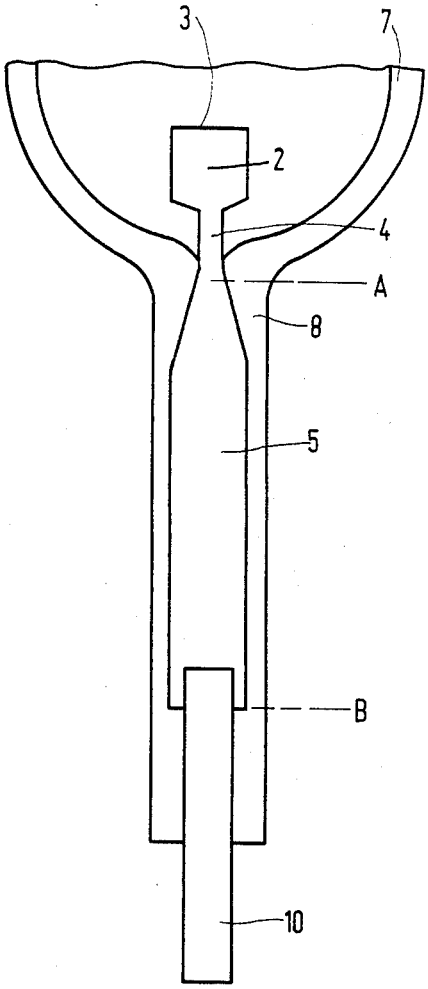
FIG. 4 is a sectional view of an end of a high-pressure gas discharge lamp having an electrode as shown in FIG. 2.

FIGS. 3 and 4 each show an end of a high-pressure gas discharge lamp having a lamp bulb 7 which consists of quartz glass and into the pinch 8 of which is sealed a lamp electrode with a sealing portion. In the lamp shown in FIG. 3, use is made of an electrode of tungsten sheet material shown in FIG. 1 having as electrode head 2 a flat substantially square plate and an adjoining current supply strip 4. This current supply strip 4 is welded to molybdenum foil 9, which serves as a sealing portion, and is given a lens-shaped cross-section by etching. A current supply pin 10, extending to the exterior, is welded to the other end of the strip 4. The current supply strip 4, the molybdenum foil 9 and the current supply pin 10 are sealed in a vacuum-tight manner into the pinch 8 of the lamp bulb 7.

The high-pressure gas discharge lamp as shown in FIG. 4 is provided with an electrode arrangement shown in FIG. 2, in which the sealing portion 5 is made in one piece with the electrode head 2 and the current supply strip 4. Between the points A and B, the tungsten sheet material of the sealing portion 5 is given a lens-shaped cross-section by etching. Again a current supply pin 10 extending to the exterior is welded to the end of the sealing portion 5.

In a 30 W mercury halide high-pressure gas discharge lamp having an outer diameter of the lamp bulb 7 of about 8 mm and a filling of mercury, sodium iodide, thallium iodide and indium iodide, the electrode head 2 consists of tungsten sheet material having a thickness of 0.1 mm and a width of about 1.1 mm. The elongate end face 3 of the electrode head 2 serving as the only termination surface for the discharge arc consequently has a surface area of about 0.11 $mm^2$. The width of the current supply strip 4 is 0.3 mm. Due to its comparatively large surface area, the electrode shown is able to emit the heat produced by the discharge arc at a point of the front end face 3 not only by heat conduction, but especially by heat radiation so that overheating of the electrode cannot occur.

What is claimed is:

1. A high-pressure discharge lamp comprising electrodes, at least one said electrode having an electrode head which consists of tungsten sheet material and on which the discharge arc terminates during operation of the lamp, characterized in that the electrode head is constructed as a plate having an elongate end face facing the discharge, arranged such that in operation said end face serves as the only termination surface for the discharge arc.

2. A high-pressure discharge lamp comprising electrodes and at least one current supply strip, at least one said electrode having an electrode head on which the discharge arc terminates during operation of the lamp, said head being connected to said strip and consisting of tungsten sheet material, characterized in that said head and strip are made of one piece of tungsten sheet material, and said head is formed as a plate having an elongate end face facing the discharge, arranged such that in operation said end face serves as the only termination surface for the discharge arc.

3. A lamp as claimed in claim 2, comprising a lamp bulb having a sealing portion embedded therein, said sealing portion being made in one piece with said at least one electrode.

4. A lamp as claimed in claim 3, characterized in that said sealing portion has a lens-shaped cross-section.

* * * * *